US009752088B2

(12) United States Patent
Sakai et al.

(10) Patent No.: US 9,752,088 B2
(45) Date of Patent: Sep. 5, 2017

(54) ASHLESS COAL PRODUCTION METHOD

(71) Applicant: KOBE STEEL, LTD., Kobe-shi (JP)

(72) Inventors: Koji Sakai, Hyogo (JP); Noriyuki Okuyama, Hyogo (JP); Shigeru Kinoshita, Hyogo (JP); Takuya Yoshida, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 15/022,116

(22) PCT Filed: Oct. 8, 2014

(86) PCT No.: PCT/JP2014/076982
§ 371 (c)(1),
(2) Date: Mar. 15, 2016

(87) PCT Pub. No.: WO2015/053332
PCT Pub. Date: Apr. 16, 2015

(65) Prior Publication Data

US 2016/0230107 A1 Aug. 11, 2016

(30) Foreign Application Priority Data

Oct. 9, 2013 (JP) ..... 2013-211996

(51) Int. Cl.
*C10L 5/04* (2006.01)
*C10L 9/00* (2006.01)
*C10L 5/00* (2006.01)

(52) U.S. Cl.
CPC *C10L 5/04* (2013.01); *C10L 5/00* (2013.01); *C10L 9/00* (2013.01); *C10L 2290/544* (2013.01)

(58) Field of Classification Search
CPC combination set(s) only.
See application file for complete search history.

(56) References Cited

U.S. PATENT DOCUMENTS 5,141,365 A * 8/1992 Smart ..... C04B 28/04 405/129.3
2008/0072476 A1 3/2008 Kennel et al.
2010/0006477 A1* 1/2010 Okuyama ..... C10L 9/10 208/428

FOREIGN PATENT DOCUMENTS

CN 102803136 11/2012
EP 2 821 461 1/2015
(Continued)

OTHER PUBLICATIONS

International Search Report issued on Jan. 6, 2015 in PCT/JP2014/076982 (with English language translation).
(Continued)

*Primary Examiner* — Prem C Singh
*Assistant Examiner* — Chantel Graham
(74) *Attorney, Agent, or Firm* — Oblon, McClelland, Maier & Neustadt, L.L.P.

(57) ABSTRACT

A method for producing an ashless coal includes an extraction step, a separation step and an ashless coal acquirement step. In the extraction step, a slurry obtained by mixing a coal with a solvent is heated and thereby a solvent-soluble component of the coal is extracted. In the separation step, the slurry is separated into a solution of the solvent-soluble component of the coal and a solid content-concentrated liquid. In the ashless coal acquirement step, an ashless coal is obtained by evaporating and separating the solvent from the solution. The solvent is a mixture of a dissolution medium and a coal extraction accelerator added thereto. The solvent contains a bicyclic aromatic compound that is liquid at ordinary temperature. The coal extraction accelerator containing no nitrogen has two benzene rings and has at least one cyclic structure having no double bond.

6 Claims, 3 Drawing Sheets

(56) References Cited

FOREIGN PATENT DOCUMENTS

| | | | |
|---|---|---|---|
| JP | 2008-115369 | A | 5/2008 |
| JP | 2013-181062 | | 9/2013 |
| WO | WO 2013/089039 | | 6/2013 |
| WO | WO 2013/099650 | | 7/2013 |
| WO | WO 2013/099665 | | 7/2013 |
| WO | WO 2013/129607 | A1 | 9/2013 |

OTHER PUBLICATIONS

Written Opinion issued on Jan. 6, 2015 in PCT/JP2014/076982 (with English language translation).

* cited by examiner

ASHLESS COAL PRODUCTION METHOD

TECHNICAL FIELD

The present invention relates to a method for ashless coal production for obtaining an ashless coal by removing ash components from a coal.

BACKGROUND ART

It has conventionally been known that high-quality ashless coals are obtained by removing ash components, etc. from coals, and techniques for improving the yield of such ashless coals are being developed. As a method for obtaining an ashless coal from a coal, there is a method in which the components other than ash components and the like, which are soluble components, are extracted from a coal by dissolving them out in a solvent and the solvent is evaporated and separated from the solution which contains the soluble components dissolved therein. According to this method, the yield of ashless coal can be improved by heightening the coal extraction rate by dissolving soluble components of the coal in the solvent as much as possible.

For that purpose, for example, the method for producing an ashless coal described in Patent Document 1 employs 1-methylnaphthalene, which has an excellent affinity for coals, as the solvent in order to heighten the extraction rate. However, a solvent which brings about a higher coal extraction rate has been desired for further improving the yield of ashless coal.

PRIOR ART DOCUMENT

Patent Document

Patent Document 1: JP-A-2008-115369

SUMMARY OF THE INVENTION

Problem that the Invention is to Solve

Among substances which are excellent in terms of coal extraction are nitrogen-containing compounds. It may be possible to use a nitrogen-containing compound as a solvent in order to heighten the rate of coal extraction. However, nitrogen-containing compounds have the property of strongly associating with components of coals. Because of this, in cases when a nitrogen-containing compound is used as a solvent, this solvent cannot be satisfactorily evaporated and separated when an ashless coal is obtained, resulting in a decrease in solvent amount in the process and rendering the efficient recycling thereof impossible. Unless the solvent can be efficiently recycled, it is necessary to additionally supply the solvent, resulting in an increase in the running cost of the process.

An object of the present invention, which has been achieved in view of the problem described above, is to improve the yield of ashless coal and to efficiently recycle a solvent.

Means for Solving the Problem

In order to accomplish the object, the method for producing an ashless coal of the present invention includes an extraction step of heating a slurry obtained by mixing a coal with a solvent and thereby extracting a component of the coal that is soluble in the solvent, a separation step of separating the slurry obtained in the extraction step into a solution in which the component of the coal that is soluble in the solvent is dissolved and a solid content-concentrated liquid in which a component of the coal that is insoluble in the solvent have been concentrated, and an ashless coal acquirement step of obtaining an ashless coal by evaporating and separating the solvent from the solution separated in the separation step, in which the solvent is a mixture including a dissolution medium which includes, as a main component, a bicyclic aromatic compound that is liquid at ordinary temperature and, added to the dissolution medium, a coal extraction accelerator which has two benzene rings and has at least one cyclic structure having no double bond and which contains no nitrogen.

As will be explained later in detail, the extraction rate of coal can be heightened by using the above-mentioned solvent. In addition, since the coal extraction accelerator contains no nitrogen, it does not strongly associate with components of the coal and the solvent can hence be evaporated and separated without causing any problem. Consequently, according to the present invention, it is possible to not only further improve the yield of an ashless coal but also efficiently recycle the solvent.

It is preferable that a concentration in percentage by weight of the coal extraction accelerator in the solvent should be 40 wt % or less. By thus regulating the concentration in percentage by weight of the coal extraction accelerator, the coal extraction accelerator can be sufficiently dissolved in the dissolution medium even when it is a solid at ordinary temperature and the coal extraction accelerator can be inhibited from remaining in a solid state in the solvent.

The coal extraction accelerator can be, for example, a substance belonging to any of an acenaphthene, a fluorene and a dibenzofuran.

In particular, suitable as the solvent is a mixture obtained by adding acenaphthene as the coal extraction accelerator to a dissolution medium including 1-methylnaphthalene as a main component. As will be explained later in detail, this configuration of the solvent greatly increases the extraction rate of coal even when acenaphthene has been added in a small amount.

It is also preferable that the solvent evaporated and separated in the ashless coal acquirement step should be circulated and utilized as the solvent for use in the extraction step. By thus configuring the method so that the solvent is circulated and utilized within the process, the solvent can be more efficiently recycled.

EMBODIMENTS FOR CARRYING OUT THE INVENTION

Embodiments of the method for producing an ashless coal according to the present invention are described below by reference to the drawings.

(Outline of the Method for Producing Ashless Coal)

Figure 1:
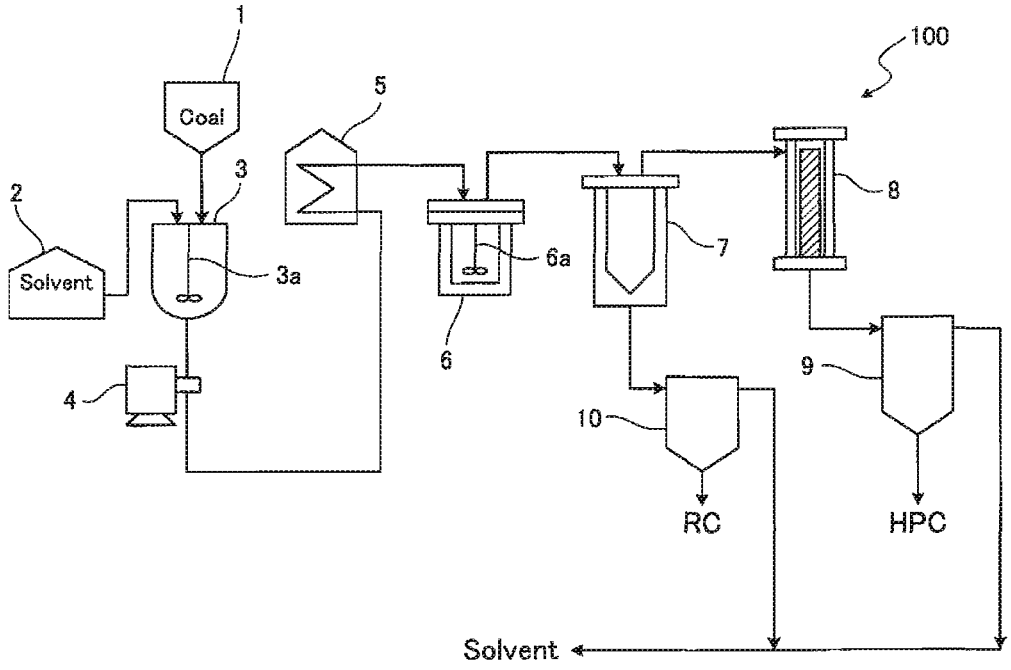
FIG. 1 is a schematic view of ashless coal production equipment.

As shown in FIG. 1, ashless coal production equipment 100 to be used in the method for ashless coal (HPC)

production according to the present embodiment includes a coal hopper 1, a solvent tank 2, a slurry preparation tank 3, a transport pump 4, a preheater 5, an extraction tank 6, a gravitational settling tank 7, a filter unit 8, and solvent separators 9 and 10. Of these, the slurry preparation tank 3, transport pump 4, preheater 5, extraction tank 6, gravitational settling tank 7, filter unit 8, and solvent separator 9 have been disposed in this order from the upstream side in the ashless coal production steps. The coal hopper 1 and the solvent tank 2 both have been disposed on the upstream side of the slurry preparation tank 3, while the solvent separator 10 has been disposed on the downstream side of the gravitational settling tank 7.

The method for ashless coal production according to this embodiment includes a slurry preparation step, an extraction step, a separation step, an ashless coal acquirement step, and a by-product coal acquirement step. Each step is explained below, and the solvent to be used for coal extraction will then be explained in detail. There are no particular limitations on the coal to be used as a raw material in this production method, and use may be made of bituminous coal, which is high in extraction rate, or a lower rank coal (subbituminous coal or brown coal), which is less expensive. The term "ashless coal" refers to one having an ash content of 5 wt % or less and preferably 3 wt % or less.

(Slurry Preparation Step)

The slurry preparation step is a step of preparing a slurry by mixing a coal is with a solvent. This slurry preparation step is performed in the slurry preparation tank 3. Specifically, a coal as a raw material is introduced into the slurry preparation tank 3 from the coal hopper 1, and a solvent is introduced into the slurry preparation tank 3 from the solvent tank 2. The coal and solvent which have been introduced are stirred with a stirrer 3*a* disposed in the slurry preparation tank 3, thereby preparing a slurry composed of the coal and the solvent.

(Extraction Step)

The extraction step is a step of heating the slurry obtained in the slurry preparation step and thereby extracting (dissolving) components of the coal which are soluble in the solvent. This extraction step is performed in the preheater 5 and the extraction tank 6. Specifically, the slurry prepared in the slurry preparation tank 3 is fed to the preheater 5 by means of the transport pump 4 and heated up to a predetermined temperature. Thereafter, this slurry is fed to the extraction tank 6 and stirred therein with a stirrer 6*a* disposed in the extraction tank 6. Thus, extraction is performed.

In this embodiment, the solvent to be used for extracting soluble components of the coal is a mixture including a dissolution medium which includes, as a main component, a bicyclic aromatic compound that is liquid at ordinary temperature (25° C.) and, added to the dissolution medium, a coal extraction accelerator which has two benzene rings and has at least one cyclic structure having no double bond and which contains no nitrogen. The expression "dissolution medium which includes a bicyclic aromatic compound as a main component" means that the concentration in percentage by weight of the bicyclic aromatic compound in the dissolution medium is 50 wt % or higher and preferably 60 wt % or higher. As will be explained later in detail, the extraction rate of coal can be heightened by using the above-mentioned solvent. In addition, since the coal extraction accelerator contains no nitrogen, it does not strongly associate with components of the coal and the solvent can hence be evaporated and separated without causing any problem in the ashless coal acquirement step which will be described later. Consequently, according to this embodiment, it is possible to not only fluffier improve the yield of an ashless coal but also efficiently recycle the solvent.

The solvent is not particularly limited in the boiling temperature thereof. From the standpoints of reductions in pressure in the extraction step and separation step, the extraction rate in the extraction step, the solvent recovery rate in the ashless coal acquirement step and by-product coal acquirement step, etc., it is preferred to use a solvent having a boiling temperature of, for example, 180-300° C. and in particular, 240-280° C.

The heating temperature of the slurry in the extraction step is not particularly limited so long as the soluble components of the coal can be dissolved. From the standpoints of sufficient dissolution of the soluble components and an improvement in extraction rate, it can be, for example, 300-420° C. and more preferably 360-400° C.

The heating time (extraction time) also is not particularly limited. However, from the standpoints of sufficient dissolution and an improvement in extraction rate, it is, for example, 10-60 minutes. Herein, the "heating time" refers to the sum of the heating time in the preheater 5 and the heating time in the extraction tank 6.

The extraction step is performed in the presence of an inert gas, e.g., nitrogen. In case where the internal pressure of the extraction tank 6 is lower than the vapor pressure of the solvent, the volatilization of the solvent is undesirably accelerated. It is therefore desirable that the internal pressure of the extraction tank 6 should be higher than the vapor pressure of the solvent. Meanwhile, in case where the pressure therein is too high, the results are increases in apparatus cost and operation cost, which is uneconomical, therefore preferable that the internal pressure of the extraction tank 6 should be 1.0-2.0 MPa, although it depends on the temperature during the extraction and on the vapor pressure of the solvent used.

(Separation Step)

The separation step is a step of separating the slurry obtained in the extraction step, by the gravitational settling method, into a solution in which the components of the coal that are soluble in the solvent are dissolved and a solid content-concentrated liquid in which components (e.g., ash components) of the coal that are insoluble in the solvent have been concentrated. This separation step is performed in the gravitational settling tank 7. Specifically, the slurry obtained in the extraction step is separated within the gravitational settling tank 7 into a solid content-concentrated liquid, which settles by the action of gravity, and a supernatant liquid as a solution. The supernatant liquid in the upper part of the gravitational settling tank 7 is discharged to the solvent separator 9, if necessary, by way of the filter unit 8, while the solid content-concentrated liquid which has settled in the lower part of the gravitational settling tank 7 is discharged to the solvent separator 10.

It is preferable that the inside of the gravitational settling tank 7 should be kept heated (or be heated) or be kept being pressurized, in order to prevent the soluble components of the coal from reprecipitating. The temperature for being kept heated (or being heated) is, for example, 300-380° C. The internal pressure of the tank is, for example, 1.0-3.0 MPa.

Besides the gravitational settling method, other methods such as a filtration method and a centrifugal separation method can be employed as the method for separating the solution containing the soluble components of the coal from the slurry obtained in the extraction step.

(Ashless Coal Acquirement Step)

The ashless coal acquirement step is a step obtaining an ashless coal by evaporating and separating the solvent from the solution (supernatant liquid) separated in the separation step. This ashless coal acquirement step is performed in the solvent separator 9. Specifically, the solution separated in the gravitational settling tank 7 is filtered with the filter unit 8 and then fed to the solvent separator 9, and the solvent is evaporated and separated from the solution in the solvent separator 9. It is preferable that the evaporative separation of the solvent from the solution should be conducted in the presence of an inert gas, e.g., nitrogen.

As a method for separating the solvent from the solution, use can be made of a common method such as a distillation method or an evaporation method. The solvent separated in the solvent separator 9 is returned to the solvent tank 2, and is circulated and repeatedly used. By thus configuring the method so that the solvent is circulated and utilized within the process, the solvent can be more efficiently recycled. An ashless coal containing substantially no ash components can be obtained by separating the solvent from the solution.

The ashless coal can be used, for example, in a coal blend as a raw material for coke. Furthermore, since the ashless coal, which contains substantially no ash components, has a high combustion efficiency and is effective in reducing coal ash production, attention is being given to application thereof as a gas turbine direct-injection fuel for high-efficiency combined-cycle power generation systems utilizing gas turbine combustion.

(By-Product Coal Acquirement Step)

The by-product coal acquirement step is a step of obtaining a by-product coal by evaporating and separating the solvent from the solid content-concentrated liquid separated in the separation step. This by-product coal acquirement step is performed in the solvent separator 10. Specifically, the solid content-concentrated liquid separated in the gravitational settling tank 7 is fed to the solvent separator 10, and the solvent is evaporated and separated from the solid content-concentrated liquid in the solvent separator 10. It is preferable that the evaporative separation of the solvent from the solid content-concentrated liquid should be conducted in the presence of an inert gas, e.g., nitrogen. The by-product coal acquirement step is not an essential step.

As a method for separating the solvent from the solid content-concentrated liquid, a common distillation method or evaporation method can be used as in the ashless coal acquirement step describe above. The solvent separated in the solvent separator 9 is returned to the solvent tank 2, and is circulated and repeatedly used. By thus configuring the method so that the solvent is circulated and utilized within the process, the solvent can be more efficiently recycled. By the separation of the solvent, a by-product coal (also called an RC, a residual coal) in which insoluble components including ash components, etc, have been concentrated can be obtained from the solid content-concentrated liquid.

(Configuration of the Solvent)

In this embodiment, the solvent to be used for coal extraction is a mixture including a dissolution medium which includes, as a main component, a bicyclic aromatic compound that is liquid at ordinary temperature and, added to the dissolution medium, a coal extraction accelerator which has two benzene rings and has at least one cyclic structure having no double bond and which contains no nitrogen, as stated above.

Examples of such dissolution medium include one which includes 1-methylnaphthalene as a main component. However, the dissolution medium is not limited thereto. Other bicyclic aromatic compounds such as 2-methylnaphthalene and dimethylnaphthalenes are usable as a main component. Meanwhile, examples of the coal extraction accelerator described above include substances belonging to acenaphthene compounds, fluorene compounds and dibenzofuran compounds. However, the coal extraction accelerator is not limited thereto. In the experiment which will be given later, acenaphthene as one of the acenaphthene compounds, fluorene as one of the fluorene compounds and dibenzofuran as one of the dibenzofuran compounds were used. However, the coal extraction accelerator is not limited to acenaphthene, fluorene and dibenzofuran, and may be other substances belonging to the acenaphthene compounds, fluorene compounds and dibenzofuran compounds. The coal extraction accelerator need not always be constituted of one substance, and may include a plurality of substances.

An experiment was conducted in which the extraction rate of coal was determined in the case where mixtures respectively obtained by adding acenaphthene belonging to acenaphthene compounds, fluorene belonging to fluorene compounds and dibenzofuran belonging to dibenzofuran compounds, to 1-methylnaphthalene were used as solvents. 1-Methylnaphthalene (see chemical formula 1) is a bicyclic aromatic compound which is liquid at ordinary temperature, and functions as a dissolution medium in this experiment. Meanwhile, acenaphthene, fluorene and dibenzofuran (see chemical formula 2) are organic compounds which each have two benzene rings and at least one cyclic structure having no double bond and which contain no nitrogen, and function as coal extraction accelerators in this experiment.

[Chem. 1]

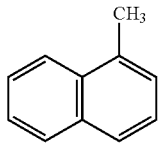

1-Methylnaphthalene

[Chem. 2]

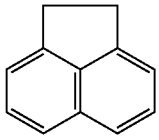

Acenaphthene

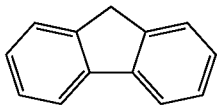

Fluorene

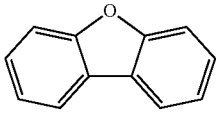

Dibenzofuran

Figure 2:
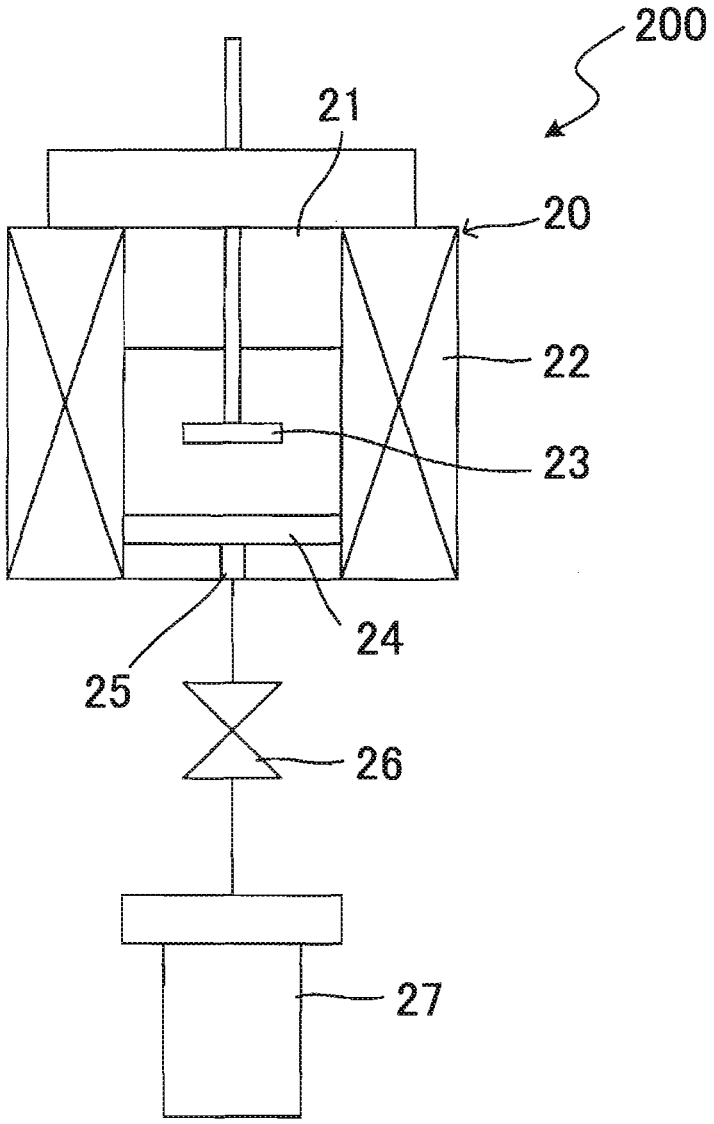
FIG. 2 is a schematic view of the heating/filtration device used in a coal extraction experiment.

In this experiment, the heating/filtration device 200 shown in FIG. 2 was used, and a slurry obtained by mixing a coal with each of the solvents was subjected to a stirring under the conditions of 380° C., 60 minutes and 2.0 MPa and then the slurry was filtered in the hot state. The proportion of the weight of the extracted soluble components of the coal [(feed coal in dry ash-free (daf))−(filtration residue in daf)] to the daf base weight of the feed coal was calculated as the extraction rate of coal.

The heating/filtration device 200 has been configured so as to include an autoclave 20, and a vessel 21 (capacity, 500 cc) thereof has been configured so that the inside thereof can be freely heated/pressurized by means of a heater 22 disposed around the vessel 21. In the vessel 21, a stirrer 23 for stirring slurry has been disposed and a filter 24 has been disposed at the bottom thereof. A nozzle 25 for discharging filtrate has further been disposed under the filter 24. A valve 26 has been connected to the nozzle 25, so that opening the valve 26 enables the filtrate which has passed through the filter 24 to be recovered in a filtrate receiver 27.

Figure 3:
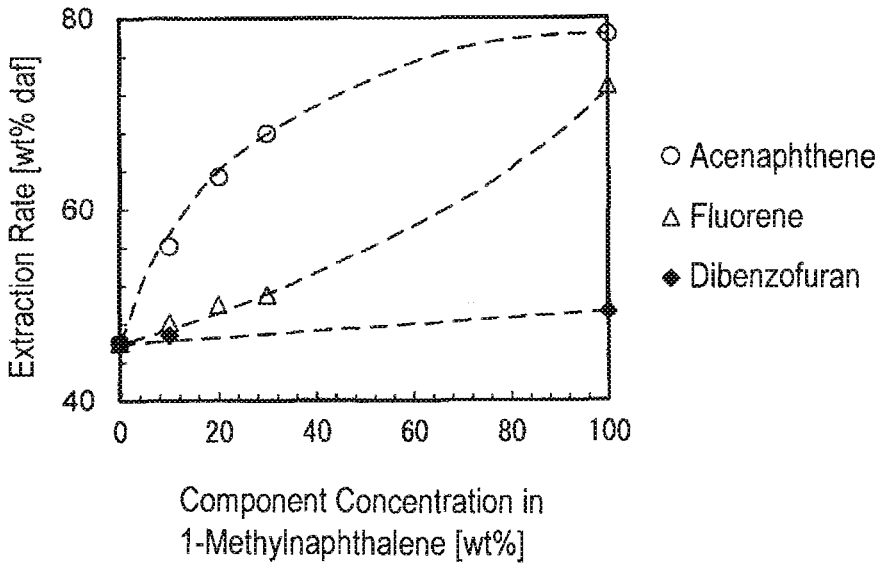
FIG. 3 is a chart which shows the results of the coal extraction experiment.

In FIG. 3 are shown the extraction rates of coal calculated for the cases where the concentrations in percentage by weight of each of acenaphthene, fluorene and dibenzofuran in 1-methylnaphthalene were 0, 10, 20, 30 (20 wt % and 30 wt % were omitted for dibenzofuran), and 100 wt %.

As shown in FIG. 3, the addition of any of acenaphthene, fluorene, and dibenzofuran as a coal extraction accelerator heightened the extraction rate of coal as compared with the case where no coal extraction accelerator was added (the case where the concentration was 0 wt %). Namely, it can be seen that the extraction rate of coal can be heightened by using, as a solvent, a mixture including a dissolution medium which includes, as a main component, a bicyclic aromatic compound that is liquid at ordinary temperature and, added to the dissolution medium, a coal extraction accelerator which has two benzene rings and has at least one cyclic structure having no double bond and which contains no nitrogen. In addition, since the coal extraction accelerator contains no nitrogen, it does not strongly associate with components of the coal and the solvent can hence be evaporated and separated in the ashless coal acquirement step without causing any problem. Consequently, due to the use of this solvent, it is possible to not only further improve the yield of an ashless coal but also efficiently recycle the solvent.

Furthermore, as apparent from FIG. 3, the extraction rate of coal gradually increases as the concentration of each coal extraction accelerator in the 1-methylnaphthalene increases. In particular, with respect to acenaphthene, the increase rate in extraction rate is large in the concentration range of about 0-30%, showing that the addition of acenaphthene even in a small amount is highly effective. Although all of acenaphthene, fluorene and dibenzofuran, which were used in this experiment, are substances that are solid at ordinary temperature, these substances can be sufficiently dissolved in 1-methylnaphthalene in an amount of up to about 40 wt % or less at ordinary temperature. Consequently, in cases when a dissolution medium including 1-methylnaphalene as a main component is used, a step for melting those substances can be omitted, which is suitable.

Meanwhile, in the experiment described above, the internal temperature of the vessel 21 of the autoclave 20 is kept at a high temperature, which is higher than the melting points of acenaphthene, fluorene and dibenzofuran and, hence, these substances are each present in a liquid state. However, in the case where a substance which is used as a coal extraction accelerator is solid at ordinary temperature and where this substance is added in an amount exceeding the solubility thereof in the dissolution medium, it is necessary to heat the solvent to around a temperature higher than the melting point of the substance.

In this case, for example, a heater may be provided to the solvent tank 2 to heat the solvent to a temperature equal to or exceeding the melting point of the coal extraction accelerator, thereby melting the coal extraction accelerator. Alternatively, a heater may be provided to the slurry preparation tank 3, and the dissolution medium, the coal extraction accelerator and a coal may be introduced into the slurry preparation tank 3 to then prepare a slurry while heating the contents to a temperature equal to or exceeding the melting point of the coal extraction accelerator.

It is however, noted that there is a possibility that the disposition of a heating means, e.g., a heater, for melting a coal extraction accelerator might result in an increase in the cost of the ashless coal production equipment 100. For avoiding this problem, the amount of the coal extraction accelerator to be added to the dissolution medium may be regulated to a value equal to or smaller than the solubility thereof at ordinary temperature, or 40 wt % or less when expressed in terms of concentration in percentage by weight. For example, the solubility of acenaphthene in 1-methylnaphthalene at ordinary temperature is 40 (corresponding to about 40 wt % in terms of concentration in percentage by weight). Consequently, by regulating the concentration of the coal extraction accelerator to 40 wt % or less, the coal extraction accelerator can be inhibited from remaining as an undissolved solid at ordinary temperature, without necessitating a heating means, and thereby the coal extraction accelerator can be effectively utilized. Although the coal extraction accelerator exhibits the effect thereof even in an amount as small as about 1 wt %, it is desirable to be added in an amount of 3 wt % or larger and preferably 5 wt % or larger.

In the experiment described above, the 1-methylnaphthalene as a dissolution medium and the acenaphthene, fluorene and dibenzofuran as coal extraction accelerators were each prepared as a pure substance. In actual ashless coal production steps, however, these need not always be pure substances.

For example, coal extraction accelerators such as acenaphthene, fluorene and dibenzofuran are contained in coal tar fractions obtained as by-products of coke production. It is hence possible to directly add such a coal tar fraction to a dissolution medium to produce a solvent. Alternatively, a coal extraction accelerator may be acquired from a coal tar fraction by extraction. Such effective utilization of coal tar fractions is expected to bring about a decrease in the cost of acquiring coal extraction accelerators. Besides coal tar fractions, other mixtures containing a coal extraction accelerator can be utilized.

The present invention should not be construed as being limited to the embodiments described above, and suitable combinations of elements of the embodiments or various modifications of the embodiments are possible within the spirit of the present invention.

While the present invention has been described in detail and with reference to specific embodiments thereof, it will be apparent to one skilled in the art that various changes and modifications can be made therein without departing from the spirit and scope thereof.

This application is based on a Japanese patent application filed on Oct. 9, 2013 (Application No. 2013-211996), the contents thereof being incorporated herein by reference.

INDUSTRIAL APPLICABILITY

According to the present invention, an ashless coal can be produced at low cost while attaining a high extraction rate of coal and a high recovery rate of solvent.

DESCRIPTION OF REFERENCE NUMERALS

1 Coal hopper
2 Solvent tank
3 Slurry preparation tank
4 Transport pump
5 Preheater
6 Extraction tank

7 Gravitational settling tank
8 Filter unit
9 Solvent separator
10 Solvent separator
100 Ashless coal production equipment

The invention claimed is:

1. A method for producing an ashless coal, the method comprising:

heating a slurry obtained by mixing a coal with a solvent and thereby extracting a component of the coal that is soluble in the solvent;

separating a slurry obtained by the extracting into a solution in which the component of the coal that is soluble in the solvent is dissolved, and a solid content-concentrated liquid in which a component of the coal that is insoluble in the solvent have been concentrated; and obtaining the ashless coal by evaporating and separating the solvent from the solution separated in the separation, wherein the solvent is a mixture obtained by adding an acenaphthene as a coal extraction accelerator to a dissolution medium comprising 1-methylnaphthalene as a main component, wherein a concentration in percentage by weight of the coal extraction accelerator in the solvent is 40 wt % or less.

2. The method for producing an ashless coal according to claim 1, wherein the solvent evaporated and separated in the obtaining ashless coal is circulated and used as the solvent for the extraction.

3. The method for producing an ashless coal according to claim 1, wherein a heating temperature of the slurry in the extracting is from 300 to 420° C.

4. The method for producing an ashless coal according to claim 3, wherein a heating temperature of the slurry in the extracting is from 360 to 400° C.

5. The method for producing an ashless coal according to claim 1, wherein a pressure of the extracting in an extraction vessel is from 1.0 to 2.0 MPa.

6. The method for producing an ashless coal according to claim 3, wherein a temperature is from 300 to 380° C. and a pressure is from 1.0 to 3.0 MPa in the separating.

* * * * *